United States Patent [19]

Palumbo

[11] 4,067,569

[45] Jan. 10, 1978

[54] SMALL BALL SLIDING IN BOTH DIRECTIONS ALONG TWO THREAD LENGTHS

[76] Inventor: Arnaldo Palumbo, Via Cristoforo Colombo, Trezzano s. Naviglio (Milan), Italy

[21] Appl. No.: 686,517

[22] Filed: May 14, 1976

[30] Foreign Application Priority Data

Sept. 22, 1975 Italy ..... 22333/75[U]

[51] Int. Cl.[2] ..... A63B 21/14; A63B 67/10

[52] U.S. Cl. ..... 272/67; 273/95 AA

[58] Field of Search ..... 273/126, 95 AA; 272/67, 272/143; 224/28 F; 46/61; 24/16 PB

[56] References Cited

U.S. PATENT DOCUMENTS

| | | | |
|---|---|---|---|
| 1,311,534 | 7/1919 | Seymour | 46/61 |
| 1,864,318 | 6/1932 | Powell | 46/61 |
| 2,773,328 | 12/1956 | Fraenkel et al. | 46/61 |
| 3,103,213 | 9/1963 | Robinson | 272/67 |
| 3,743,280 | 7/1973 | Martinez | 273/109 |
| 3,893,256 | 7/1975 | Wolf et al. | 273/95 R |

FOREIGN PATENT DOCUMENTS

| | | | |
|---|---|---|---|
| 1,086,297 | 7/1954 | France | 24/16 PB |

*Primary Examiner*—William H. Grieb
*Assistant Examiner*—Lawrence E. Anderson
*Attorney, Agent, or Firm*—Buchnam and Archer

[57] ABSTRACT

A ball likely to slide along two thread lengths, characterized by an egg-shaped configuration and provided with an axial through-hole, wherein into the said through-hole there are fitted two thread sections of a suitable length, which are fastened at the ends to anchoring members, consisting of a thin strip of flexible material, carrying at one end a loop, the other end of the same thin strip having an arrow shape and being provided with a central hole to which there are connected the thread sections themselves by means of a knot.

3 Claims, 3 Drawing Figures

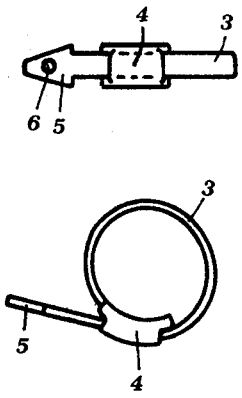
Fig. 1
Fig. 2
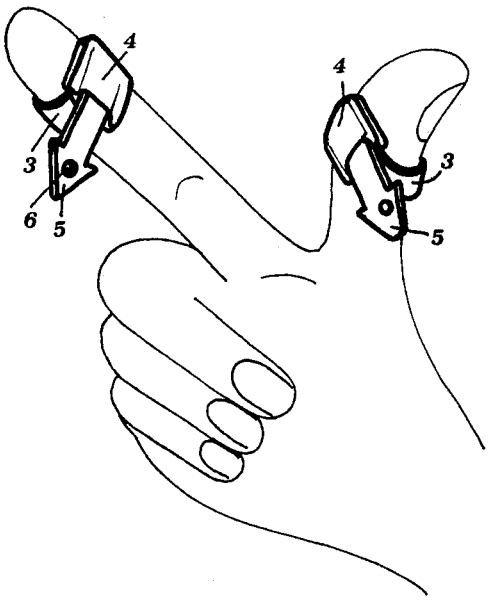
Fig. 3
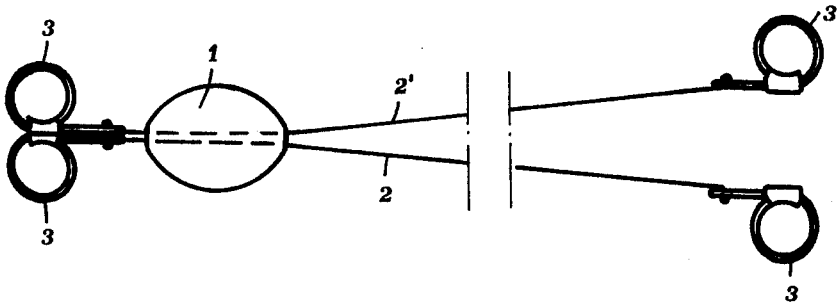

SMALL BALL SLIDING IN BOTH DIRECTIONS ALONG TWO THREAD LENGTHS

This invention relates to a perforated ball, preferably of an egg-shaped configuration, which may be caused to slide in both directions along two thread lengths.

Such thread lengths are made divergent from the one or the other end by the action of two hand fingers. More in detail, the ball of this invention is provided with a through-hole, formed at its larger axis. Into the above-mentioned hole fit two thread lengths of equal length the ends of which are connected to members being structurally built like a slip knot. The said slip knot members consist in practice of a strip of flexible material provided with a loop into which may slide the free end of the strip itself folded thereon so as to form a button-hole.

The button-holes supporting the two thread lengths are fitted over the thumb and fore-finger, respectively, of the two hands, keeping the thread lengths under tension. Consequently, by opening the fingers of one hand, it is possible to have the ball slide towards the opposite hand. Subsequently, by joining the fingers of the first hand and opening the fingers of the other hand, there is obtained the sliding of the ball in the opposite direction These and further characteristic features of a functional and constructional nature of the ball likely to slide along two thread lengths according to this invention may better be understood from the following detailed description taken in conjunction with the various figures on the accompanying drawing, in which:

FIG. 1 shows the organ for hooking the two threads to two fingers of the hands;

FIG. 2 represents the same organ as above, fitted over the thumb and fore-finger of one hand; and FIG. 3 shows the ball of this invention, fitted over the two thread lengths.

Referring now particularly to the reference numerals of the various figures on the accompanying drawing, the ball 1 of this invention shows preferably an egg-shaped configuration and is provided with an axial through-hole. Inside such orifice there are fitted two thread lengths 2 and 2' of a suitable length, which are fastened at the ends of the members 3.

The latter consists of a thin strip of flexible material, carrying at one end a loop 4. The other end of the same thin strip shows instead an arrow configuration 5 and is provided with a central through-orifice 6, wherein there is anchored by means of a knot the end of one of the thread lengths 2 and 2'. The said arrow-shaped end fits in particular into the loop 4 so as to impart to the thin strip 3 an annular configuration. The pairs of members 3, being connected to the corresponding ends of the thread lengths are fitted over the thumb and fore-finger respectively of one hand having care that the arrow-shaped end 5 of the members themselves be facing each other. By such arrangement, the tension exerted on the thread lengths to cause the ball to slide contributes to tightly secure the members 3 on the fingers themselves.

What I claim is:

1. An exercizing and recreational device comprising a pair of cords of equal length, four anchoring members each of which is fastened at each end of the cords and is adapted to be separately and securely engaged by a finger of the user, the two ends of the cords on the same side being held by two fingers of the same hand of the user, a ball of egg shape configuration having an axial orifice, the cords passing through said orifice and being freely slidable therethrough, the ball sliding towards the front hand when the fingers of the second hand are pulled apart and the ball sliding towards the second hand when the fingers of the second hand are joined together and the fingers of the first hand are pulled apart, the length of the cords being such that when said anchoring members are engaged by the fingers of the two hands of the user, the cords are under tension, each of said anchoring members consisting of a thin strip of flexible material carrying a loop at one end and having an arrow-shaped portion at the other end, said arrow-shaped portion fitting into said loop so as to impart to the strip an annular configuration, said arrow shaped portion having a central orifice for anchoring the ends of said cords.

2. The device according to claim 1 wherein each end of the cords is anchored to said orifice by means of a knot.

3. The device according to claim 1 wherein said two fingers of the same hand are the thumb and the forefinger and the arrow-shaped portion of the anchoring member which is engaged by the thumb faces the arrow shaped portion of the anchoring member which is engaged by the forefinger.

* * * * *